US006071079A

United States Patent [19]

Litvin

[11] Patent Number: 6,071,079

[45] Date of Patent: Jun. 6, 2000

[54] HIGH VELOCITY FAN

[75] Inventor: Charles Litvin, West Chester, Pa.

[73] Assignee: Lasko Holdings, Inc. USA, West Chester, Pa.

[21] Appl. No.: 09/049,356

[22] Filed: Mar. 27, 1998

[51] Int. Cl.[7] ..... F01D 25/00

[52] U.S. Cl. ..... 416/247 R; 415/121.2

[58] Field of Search ..... 415/121.2, 191; 416/247 R

[56] References Cited

U.S. PATENT DOCUMENTS 2,950,859 8/1960 Kirk ..... 415/119

5,259,726 11/1993 Bacria ..... 416/247 R

FOREIGN PATENT DOCUMENTS 368858 3/1932 United Kingdom ..... 416/247 R

*Primary Examiner*—Edward K. Look
*Assistant Examiner*—Liam McDowell
*Attorney, Agent, or Firm*—Zachary T. Wobensmith, III

[57] ABSTRACT

A high velocity fan for supplying forced air where the fan has a front grill with its air delivery area having aerodynamically formed spaced radial ribs that increase the velocity of the delivered air over the conventional round wire rib grill.

4 Claims, 5 Drawing Sheets

Air Velocity Data Points At 9Ft.

Actual Data Points

| | -40 | -36 | -32 | -28 | -24 | -20 | -16 | -12 | -8 | -4 | 0 | 4 | 8 | 12 | 16 | 20 | 24 | 28 | 32 | 36 | 40 |
|---|---|---|---|---|---|---|---|---|---|---|---|---|---|---|---|---|---|---|---|---|---|
| Test#1 | | | | | | 90 | 134 | 237 | 280 | 378 | 409 | 395 | 319 | 246 | 173 | 98 | | | | | |
| Test#2 | | | | | 90 | 157 | 210 | 297 | 353 | 419 | 424 | 420 | 373 | 293 | 238 | 165 | | | | | |
| Test#3 | | | | | 115 | 126 | 259 | 313 | 412 | 486 | 504 | 435 | 330 | 284 | 200 | 135 | | | | | |
| Test#4 | | | | | | 87 | 201 | 312 | 403 | 487 | 514 | 485 | 417 | 310 | 230 | 173 | 125 | | | | |
| Test#5 | | | | | | | | | | | | | | | | | | | | | |
| Test#6 | | | | | | | | | | | | | | | | | | | | | |

FIG. 6

Construction

| | Date | Body | Blade | Motor | Notes |
|---|---|---|---|---|---|
| Test#1 | 2/2/98 | PRODUCTION 16" O S C. FAN | MOLD #"66" | PRODUCTION SUPREME 16" | PLASTIC REAR GUARD, METAL FRONT GUARD |
| Test#2 | 2/2/98 | PRODUCTION 16" OSC. FAN | MOLD# "66" | PRODUCTION SUPREME 16" | PLASTIC REAR GUARD ONLY |
| Test#3 | 2/2/98 | PRODUCTION 16" OSC. FAN | MOLD #"66" | PRODUCTION SUPREME 16" | NO GRILLS |
| Test#4 | 2/2/98 | PRODUCTION 16" OSC. FAN | MOLD# "66" | PRODUCTION SUPREME 16" | PLASTIC REAR GUARD-VELOCITY IMPROVING FRONT GUARD |
| Test#5 | | | | | |
| Test#6 | | | | | |

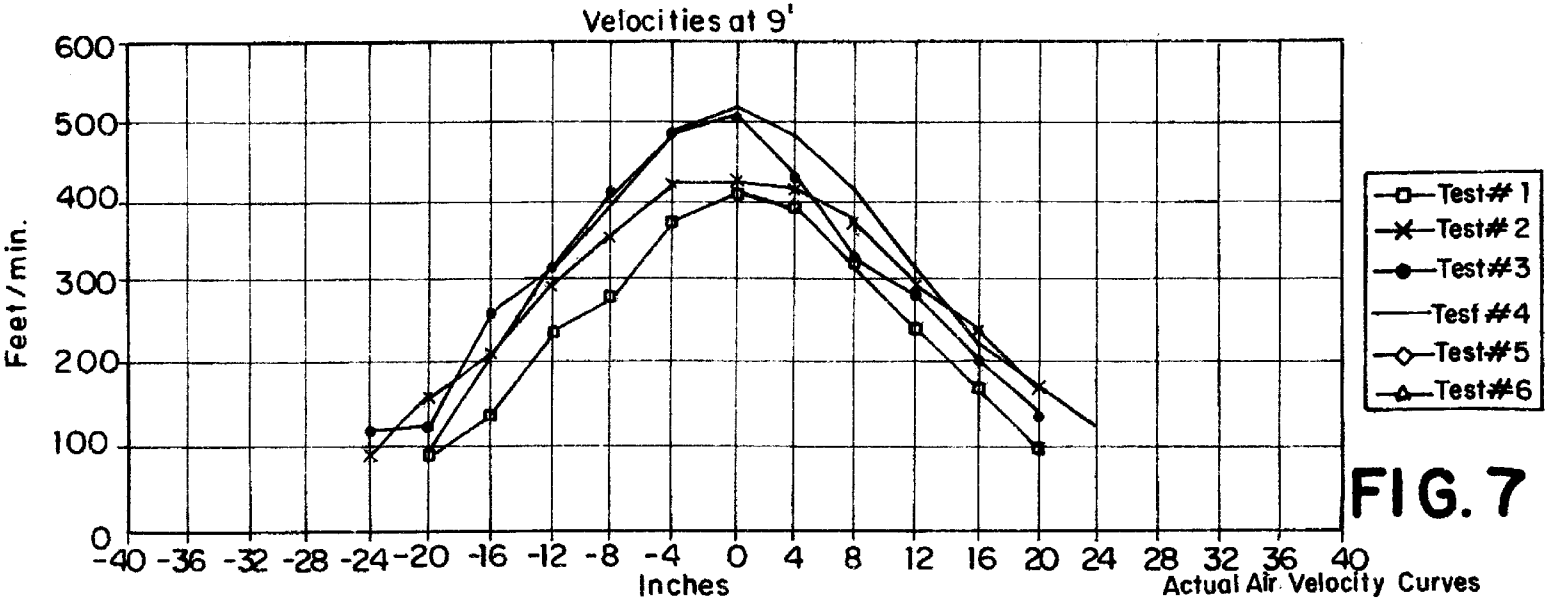

FIG. 7

HIGH VELOCITY FAN

BACKGROUND OF THE INVENTION

1. Field of the Invention

This invention relates to a high velocity fan of the type where an area of its front grill aerodynamically shaped radial ribs which provide increased delivered air velocity.

2. Description of the Prior Art

Improving the efficiency of fan operation is a goal of designers and consumers, for cost reduction, and improvement of the velocity of the delivered air without increasing the size or speed of the fan motor.

Conventional grills or guards used in fans such as floor and window fans are usually formed of round wire, which construction was considered to be economical to construct, and thought to provide adequate delivered air velocity. Upon conducting tests on these fans the round wire grill was found to offer high air resistance.

Tests on the conventional grills indicated that to increase the delivered air velocity, the front fan grill in the area where air is delivered was critical. Accordingly, the grill was redesigned to provide oblong aerodynamic ribs which dramatically increased the delivered air velocity, does not suffer from the problems of the prior art and offers other advantages.

SUMMARY OF THE INVENTION

It has now been found that a high velocity fan can be constructed which has a front grill with an air delivery area which has aerodynamically shaped ribs, which increases the air flow and the resultant velocity of air delivered by the fan.

The principal object of the invention is to provide a fan that has an aerodynamic front grill air delivery area which produces increased delivered air velocity.

A further object of the invention is to provide a high velocity fan whose front grill is constructed of molded plastic.

A further object of the invention is to provide a high velocity fan that is sturdy and reliable in operation.

A further object of the invention is to provide a high velocity fan whose grill construction can be adapted to a variety of types and sizes of fans.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which:

FIG. 6 is a table of test data for different grill configurations, and

FIG. 7 is a graph of the plotted test data from the table of FIG. 6.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
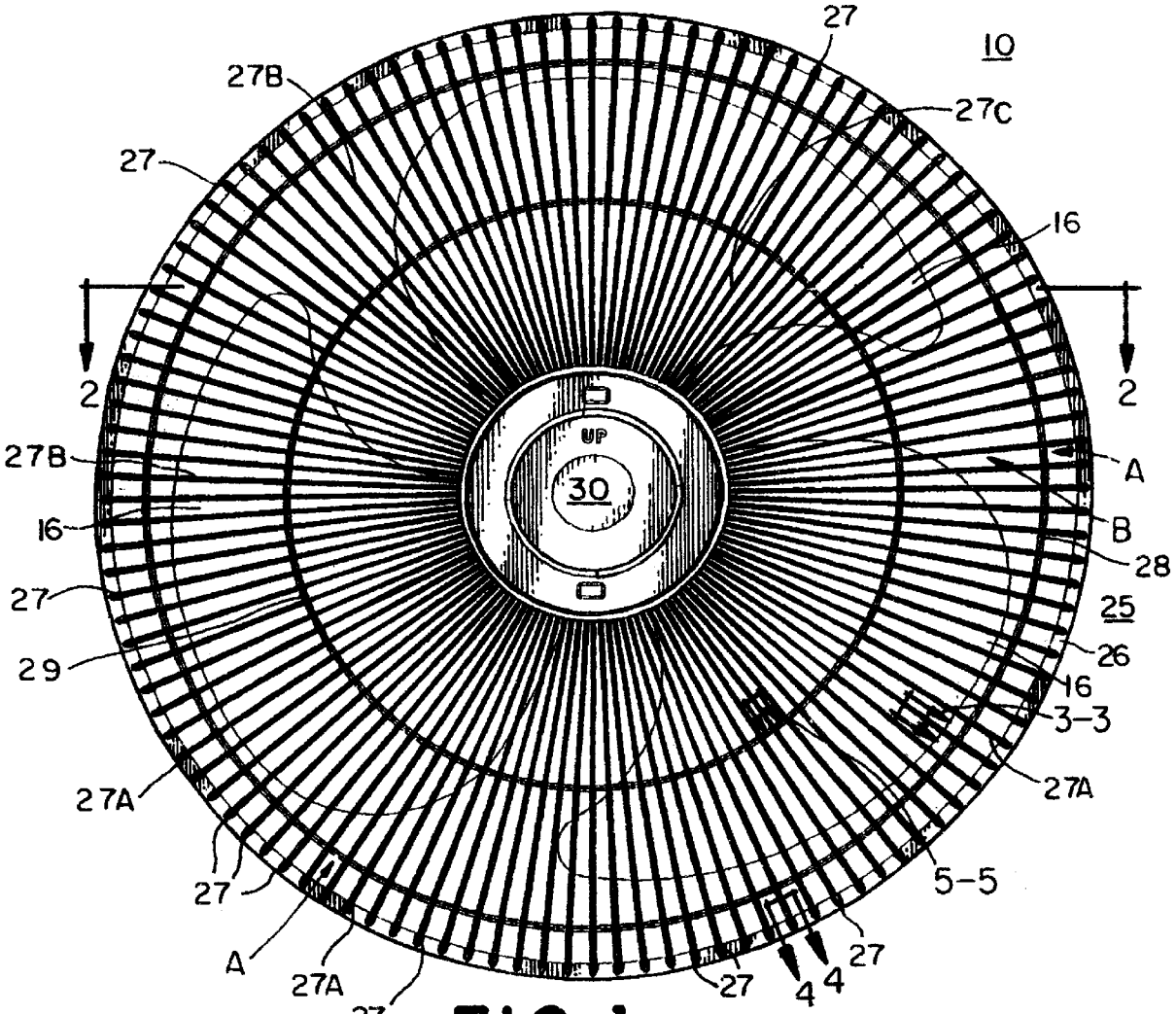
FIG. 1 is a front elevational view of a high velocity fan constructed in accordance with the invention.
Figure 2:
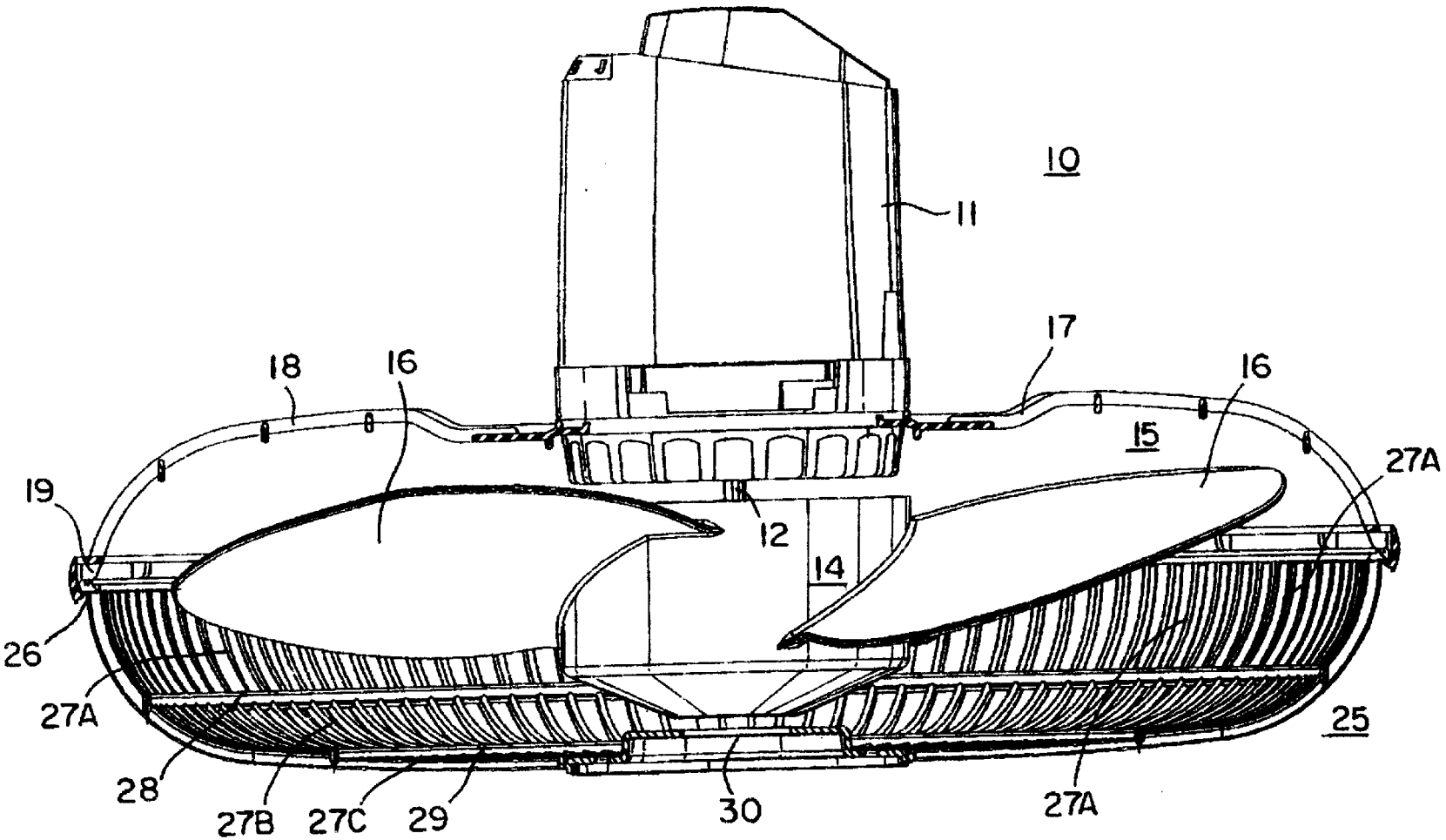
FIG. 2 is a horizontal sectional view taken approximately on the Line 2—2 of FIG. 1.

Referring now more particularly to FIGS. 1 and 2 of the drawings, a typical fan 10 is illustrated. The fan 10 includes an electric motor housing 11, which contains an electric motor (not shown) of well known type, which may be connected to a source of electrical power (not shown). The fan motor has an output shaft 12, with a hub 14 of a blade assembly 15 attached thereto, with three blades 16 being shown.

The fan motor housing 11 is mounted to a rear grill/guard 17, which can be carried in a yoke (not shown), which can be mounted on a pedestal (not shown) or other well known support structure, which can rest on the floor, on a table, or in a window as desired.

The rear grill 17 is of circular configuration with a plurality of spaced radial ribs 18 which are connected to the housing 11, and extend around to a circumferential ring 19.

A front grill 25 is provided, of circular configuration, which has a circumferential ring 26, which is engaged with the ring 19 of rear grill 17.

The front grill 25 has a plurality of spaced ribs 27 which extend around in front of ring 26 through areas A, B, and C. The ribs 27 extend through area A, which is an air intake area, to a first reinforcing ring 28 to which they are connected. The ribs 27 continue through area B, which is the air delivery area to a second reinforcing ring 29 to which they are connected and through area C to a circular center plate 30 to which they are also connected.

The rear grill 17 and the front grill 25 are preferably formed of molded plastic.

Figure 4:
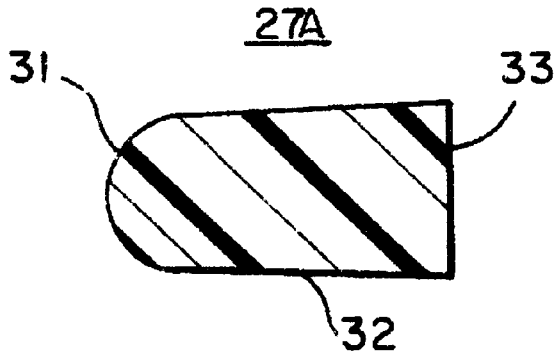
FIG. 4 is a sectional view, enlarged, taken approximately on the Line 4—4 of FIG. 1.

Referring to FIG. 4, a segment 27A of a rib 27 is shown in cross section as it extends in area A from ring 26 to ring 28. The rib segment 27A has a circular front end 31, which is connected to an outwardly tapered rear end 32, which has a flat face 33.

The rib segment 27A for the preferred embodiment has a front end radius of 0.042 inch, a thickness of 0.186 inch and a rear width of 0.100 inch.

Figure 5:
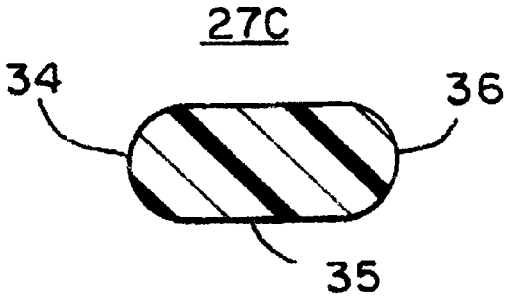
FIG. 5 is a sectional view, enlarged, taken approximately on the Line 5—5 of FIG. 1.

Referring to FIG. 5 a segment 27C of the rib 27 is shown in cross section as it extends from ring 29 to center plate 30 through area C, the segment having a front circular end 34 with a radius of 0.030 inches, and a flat intermediate portion 35, which is connected to a circular rear end 36, which has a radius of 0.031 inches. The segment 27C is of a thickness of 0.142 inches.

Figure 3:
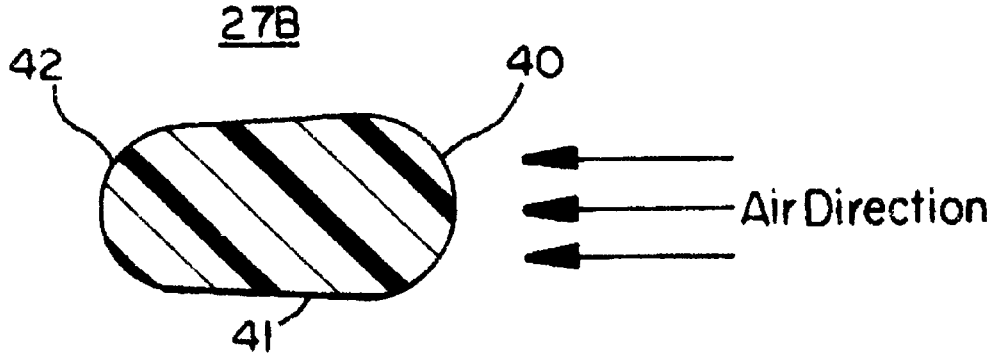
FIG. 3 is a sectional view, enlarged, taken approximately on the Line 3—3 of FIG. 1.

Referring to FIG. 3, a segment 27B of rib 27 extends in area B from ring 28 to ring 29.

The segment 27B is of oblong configuration as seen in FIG. 3 with a circular front end 40, which faces the air flow, which is connected to an intermediate portion 41 illustrated as tapered, which is connected to a circular rear end 42.

The diameter (D) of the front end 40, the diameter (D1) of rear end 42, and the thickness of the segment 27B varies with the diameter (D) of the front end 40. The diameter (D) variation is in the range from 0.030 through 0.250 inches, the rear end diameter (D1) is less than diameter (D) and increases as diameter (D) increases, with the thickness being more than diameter (D) and less than one inch.

The segment 27B for the preferred embodiment has a front end radius of 0.042 inches, a rear end radius of 0.032 inches and a thickness of 0.186 inches.

Referring now to FIG. 6 a table of air velocity data points is illustrated, from four fan performance tests, which data points were measured at a distance of nine feet from a 16 inch oscillating fan, which was operated with different grill configurations. Test no. 1 was run with the fan having a standard plastic rear grill and the standard round metal wire front grill, with the radius of the wire being 0.030 inches.

Test no. 2 was run with no front grill and with only the standard plastic rear grill.

Test no. 3 was run without a front or rear grill guard.

Test no. 4 was run with the standard plastic rear grill and an improved front plastic grill constructed in accordance with the invention.

The results of the tests were plotted in graph form in FIG. 7 and illustrate that an increased air velocity of approximately 25% was obtained from use of the improved front grill/guard over the standard round metal wire grill.

It will be seen that an improved high velocity fan has been provided with which the objects of the invention are achieved.

I claim:

1. A high velocity fan which has a fan motor, a plurality of blades attached to and driven by the motor, a rear grill to which the motor is mounted and a front grill, the improvement which comprises said front grill having a circumferential ring a plurality of spaced radial ribs connected to said circumferential ring and extending around to a first reinforcing ring forming an air intake area A;

said radial ribs extending from said first reinforcing ring to a second reinforcing ring forming an air delivery area B;

said radial ribs extending from said second reinforcing ring to a center plate forming an area C; and said radial ribs in said air delivery area B are of oblong configuration in cross section.

2. A high velocity fan as defined in claim 1 in which said radial ribs front end each has a front end radius of 0.042 inches, a rear end radius of 0.032 inches, and a thickness of 0.186 inches.

3. A high velocity fan as defined in claim 1 in which the diameter of the front end of the ribs is in the range of 0.030 to 0.250 inches, the rear end diameter is in the range of 0.030 inches to 0.250 inches and the thickness is greater than the range of 0.030 to 0.250 inches and less than one inch.

4. A high velocity fan as defined in claim 1 in which said front grill is of molded plastic.

* * * * *

UNITED STATES PATENT AND TRADEMARK OFFICE

CERTIFICATE OF CORRECTION

PATENT NO. : 6,071,079
DATED : June 6, 2000
INVENTOR(S) : Charles Litvin

It is certified that error appears in the above-indentified patent and that said Letters Patent is hereby corrected as shown below:

In claim 1, line 14, --, having a circular front end, an intermediate connecting portion and a circular rear end, wherein the circular front end has a larger radius than the radius of the circular rear end-- is inserted after "section".

Signed and Sealed this

Twentieth Day of March, 2001

Nicholas P. Godici

*Attest:*

NICHOLAS P. GODICI

*Attesting Officer*

*Acting Director of the United States Patent and Trademark Office*